US008490720B2

(12) United States Patent
Hart et al.

(10) Patent No.: US 8,490,720 B2
(45) Date of Patent: Jul. 23, 2013

(54) SELF ALIGNING MUD SAVER VALVE SEAT

(76) Inventors: Tace Parley Hart, Richmond, TX (US); Albert Augustus Mullins, Boling, TX (US)

( * ) Notice: Subject to any disclaimer, the term of this patent is extended or adjusted under 35 U.S.C. 154(b) by 334 days.

(21) Appl. No.: 12/856,186

(22) Filed: Aug. 13, 2010

(65) Prior Publication Data

US 2011/0036586 A1 Feb. 17, 2011

Related U.S. Application Data

(60) Provisional application No. 61/234,528, filed on Aug. 17, 2009.

(51) Int. Cl.
*E21B 21/01* (2006.01)
*E21B 34/00* (2006.01)

(52) U.S. Cl.
USPC ..... 175/218; 166/320; 175/232; 137/542; 137/493.9; 251/337

(58) Field of Classification Search
USPC ..... 166/80.1, 84.1, 84.2, 84.4, 95.1, 166/97.1, 373, 386; 175/207, 218, 232; 137/542, 493.9; 251/337
See application file for complete search history.

(56) References Cited

U.S. PATENT DOCUMENTS

| | | | | |
|---|---|---|---|---|
| 3,698,426 | A * | 10/1972 | Litchfield et al. | 137/512.1 |
| 3,738,436 | A * | 6/1973 | Litchfield et al. | 175/65 |
| 3,887,196 | A * | 6/1975 | Renfrow | 277/318 |
| 3,965,980 | A * | 6/1976 | Williamson | 166/321 |
| 3,967,679 | A * | 7/1976 | Liljestrand | 166/317 |
| 3,967,680 | A * | 7/1976 | Jeter | 175/38 |
| 4,128,108 | A | 12/1978 | Parker et al. | |
| 4,955,949 | A | 9/1990 | Bailey et al. | |
| 4,962,819 | A | 10/1990 | Bailey et al. | |
| 5,246,069 | A * | 9/1993 | Glaser et al. | 166/156 |
| 5,836,395 | A * | 11/1998 | Budde | 166/321 |
| 6,142,783 | A | 11/2000 | Rocha | |
| 6,289,911 | B1 * | 9/2001 | Majkovic | 137/1 |
| 6,640,824 | B2 * | 11/2003 | Majkovic | 137/71 |
| 7,163,066 | B2 * | 1/2007 | Lehr | 166/386 |
| 7,284,602 | B2 * | 10/2007 | Tessier et al. | 166/84.1 |
| 7,299,880 | B2 * | 11/2007 | Logiudice et al. | 166/381 |
| 8,141,642 | B2 * | 3/2012 | Olstad et al. | 166/319 |
| 2001/0037900 | A1 * | 11/2001 | Majkovic | 175/218 |
| 2004/0000406 | A1 * | 1/2004 | Allamon et al. | 166/373 |
| 2005/0257936 | A1 * | 11/2005 | Lehr | 166/386 |
| 2006/0011354 | A1 * | 1/2006 | Logiudice et al. | 166/380 |
| 2006/0272804 | A1 | 12/2006 | Tessier et al. | |
| 2007/0039759 | A1 * | 2/2007 | Foley, Jr. | 175/113 |
| 2010/0193196 | A1 * | 8/2010 | McGarian | 166/373 |
| 2012/0080182 | A1 * | 4/2012 | Mullins | 166/88.2 |

* cited by examiner

*Primary Examiner* — Jennifer H Gay
(74) *Attorney, Agent, or Firm* — Steve Rosenblatt

(57) ABSTRACT

A mud saver valve is constructed so that the valve seats self align preventing the loss of fluid when the valve is in the closed position. One or both seats can skew their longitudinal axes to get the alignment.

15 Claims, 3 Drawing Sheets

SELF ALIGNING MUD SAVER VALVE SEAT

CROSS-REFERENCE TO RELATED APPLICATION

This application claims the benefit of U.S. Provisional Patent Application Ser. No. 61/234,528 filed Aug. 17, 2009.

FIELD OF THE INVENTION

The field of this invention relates to a method of preventing the leakage or spillage of mud in a drilling environment using a valve having at least on floating seat to provide self-alignment of both seats in the valve.

BACKGROUND OF THE INVENTION

During the process of drilling and completing a well it is necessary to run or pull the pipe into or out of the wellbore. When one section of pipe is removed from the top drive or kelly, mud which is located above the pipe being removed will spill on the rig floor or into the environment. Mud saver valves are available and are in use for the purpose of preventing such spillage. These valves have at least one seat, which is firmly attached to a rigid portion of the valve system. The second seat is firmly guided into contact with the first seat such that if the seats are not perfectly aligned there will be a leak path between them. In practice these devices seldom form a perfect seal and will allow mud to leak onto the rig floor or into the environment. Such an example is disclosed in a Product Bulletin titled "Mud Saver Valve" from Smith Services, a business unit of Smith International.

Accordingly, it is an object of the present invention to provide a mud saver valve having a seat with at least one seat allowed to float allowing the seats to self align when forced together over their entire surface to prevent leakage of fluid. It is recognized that both seats could be allowed to float further assuring alignment of the sealing faces to provide a seal.

SUMMARY OF THE INVENTION

A mud saver valve attached to a top drive or kelly is disclosed which has at least one floating, self aligning seat to prevent the leakage of mud when sections of pipe below the valve are removed. Such a valve has many uses other than being placed on a top drive or kelly. For example such a valve can be used with casing or drill pipe fill-up or circulating equipment to prevent leakage of mud.

DETAILED DESCRIPTION OF THE PREFERRED EMBODIMENT

Figure 1A:
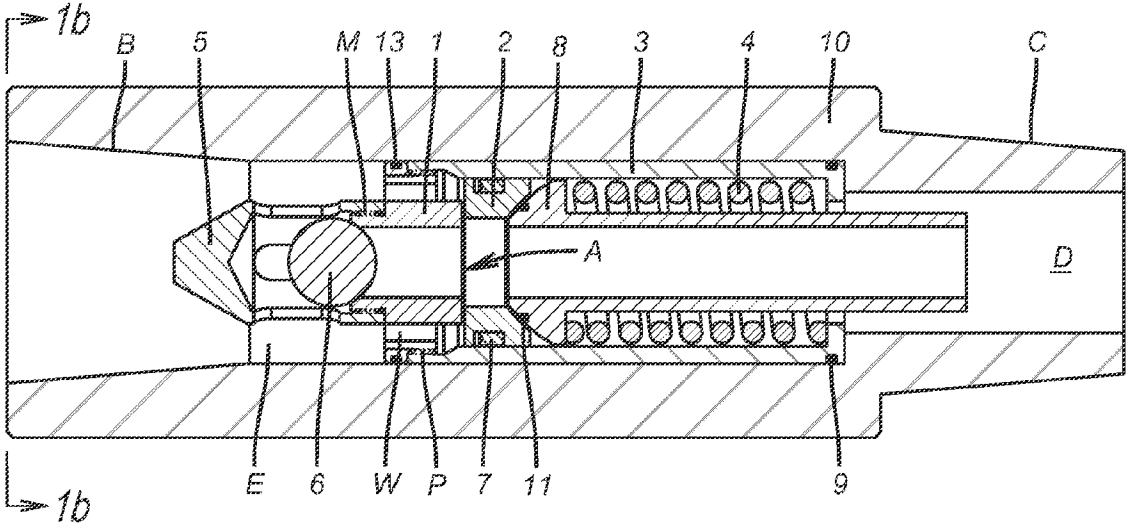
FIG. 1*a* is a sectional view of the apparatus shown in the closed position.
Figure 1B:
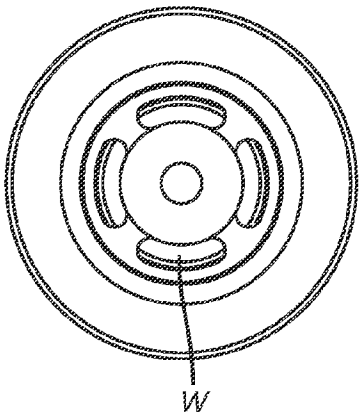
FIG. 1*b* is an end view along lines lb-lb of FIG. 1*a*.

Referring to FIG. 1, the apparatus is shown inserted into a section of the drill string 10 known as a saver sub. The saver sub is attached to the lower most portion of a top drive, kelly or in a section of a fill-up and circulating device (not shown) at thread B. Drill pipe is attached to the saver sub by and at thread C. Drilling mud is pumped through the central bore E, D of the saver sub 10. When a section of drill pipe is to be added to the drill string the previous section of drill pipe attached below the saver sub is unscrewed at thread C from the saver sub and another length of drill pipe is added. When thread C is disconnected the mud in the top drive or kelly wants to flow out of the saver sub.

The valve consists of a lower seat 2 inside of a housing 3, supported by mandrel 8. Seal 9 prevents fluid from flowing between the housing 3 and saver sub 10. A seal 7 is located between the seat 2 and housing 3. Seat 2 has clearance around seal 7 so that it can relatively rotate with respect to upper seat 1 to improve the alignment at A to enhance the quality of the seal in the closed position of FIG. 1. Seal 11 between lower seat 2 and mandrel 8 prevents flow of fluid to prevent erosion of seat 2, mandrel 8 and the spring 4. Seal 13 is located between upper seat 1 and saver sub 10.

The lower seat 2 and mandrel 8 are forced upward by a spring 4. These components are assembled inside of housing 3 and held in place by upper seat 1. Upper seat 1 is attached to housing 3 at P. Housing 1 has a seal 13 against bore E. The spring force from spring 4 urges mandrel 8 upward into contact with lower seat 2. This surface is shown to be arcuate or rounded to allow seat 2 to float or pivot about the center of the arcuate or rounded portion of mandrel 8. As mandrel 8 and lower seat 2 are forced upward seat 2 contacts upper seat 1 and rotates about the arcuate or rounded surface to force the valve surfaces at A to be in close alignment and firm contact across the entire junction A. When these two surfaces are in close contact is a seal formed. A ball 6 is shown on top of seat 1 also forming a seal between these two surfaces. Ball 6 prevents fluid from flowing out of the valve but allows pressure below the ball 6 to push the ball 6 up so that fluid below the valve can freely flow in an upward direction through the valve. The ball 6 is retained close to seat 1 with a cap 5 which is attached to upper seat 1 at M.

With the valve in the FIG. 1 closed position and fluid pressure above ball 6 seated on seat 1, the valve will not open until the pressure above seated ball 6 exceeds the force of the spring 4 on the lower seat 2 and mandrel 8.

Figure 2:
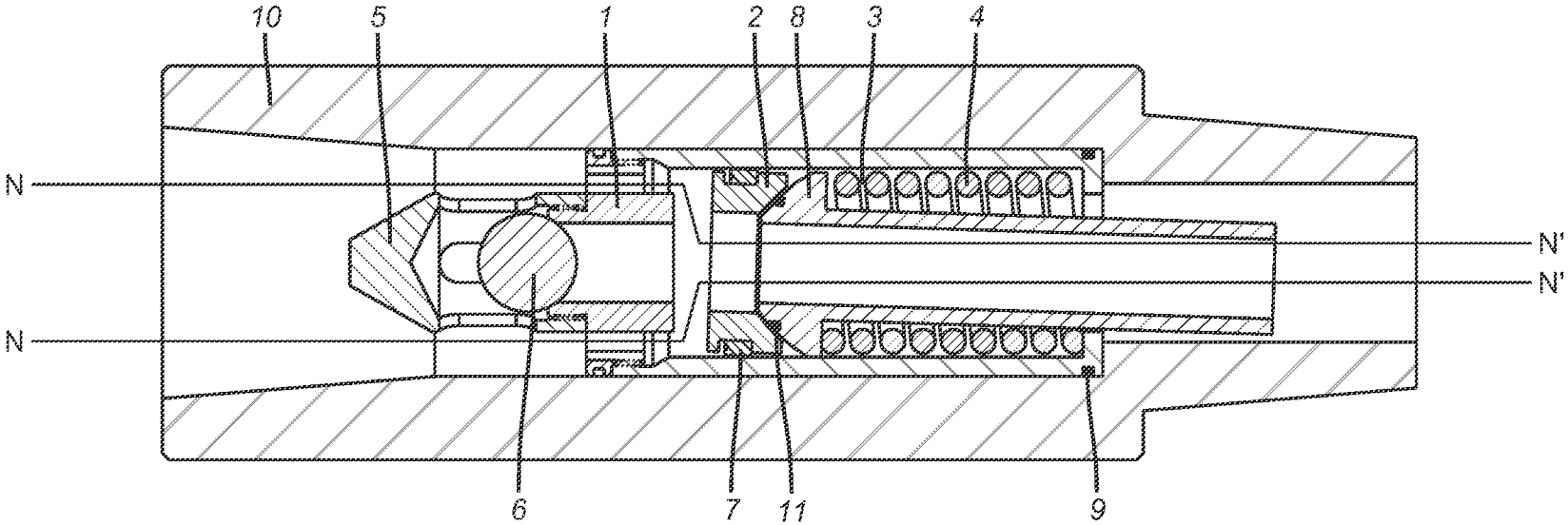
FIG. 2 is a sectional view of the apparatus shown in the open position.

Referring to FIG. 2, the saver sub 10 is shown in the open position with fluid flowing along flow lines N-N'. Seat 2 and mandrel 8 are forced downward compressing spring 4 by the differential pressure across the area formed by seal 7 and the inside diameter of mandrel 8. Flow goes through annular passage W. When flow stops spring 4 will urge the mandrel 8 and lower seat 2 into contact with upper seat 1 forming a seal and preventing fluid from falling out of the valve.

Those skilled in the art will appreciate that the rounded or arcuate portion of the top end of the mandrel 8 allows the seal 7 to be aligned with the seal 11 to improve the sealing quality of the assembly and reduce or prevent unwanted mud spillage when the string is disconnected to add or remove a joint.

Figure 3:
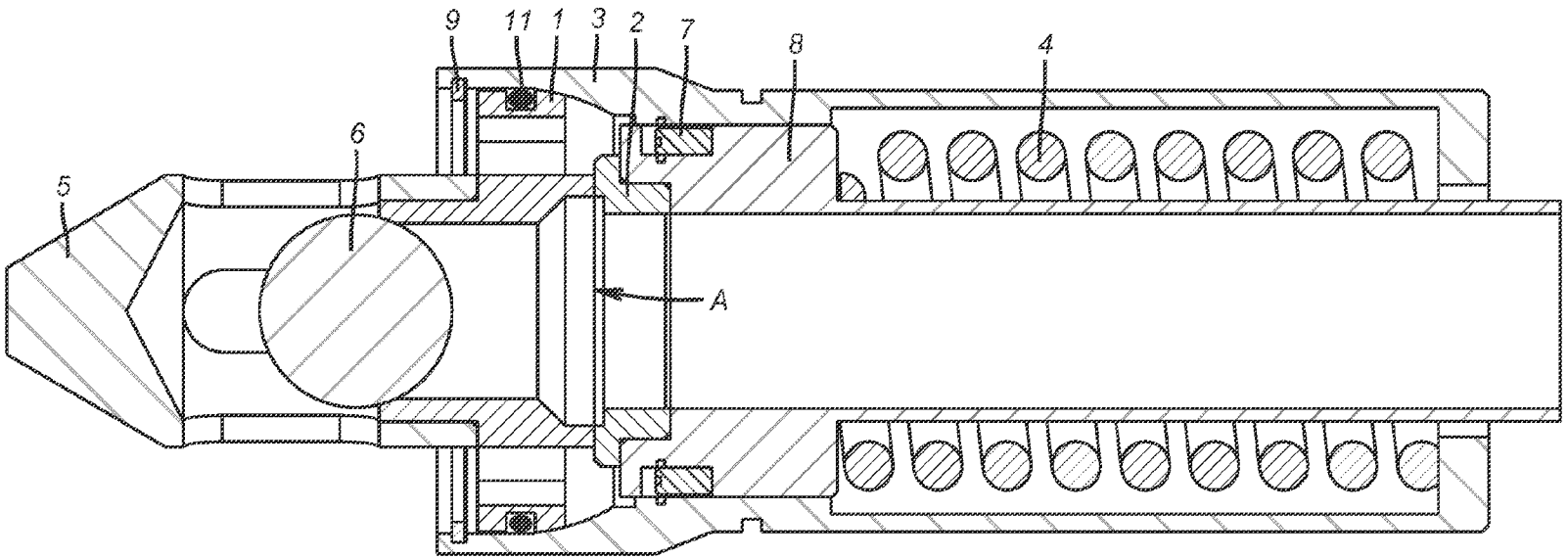
FIG. 3 is a sectional view of alternate design shown in the closed position.

Referring now to FIG. 3 The saver sub is not shown in this view, only the mud saver valve itself. The valve consists of a lower seat 2 attached to a mandrel 8, which is guided in a seal surface of housing 3. Seal 7 forms a tight seal with the seal bore of housing 3 to prevent fluid from flowing through the valve. The lower seat 2 and mandrel 8 are forced upward by a spring 4. These components are assembled inside of housing 3 and held in place by upper seat 1. Upper seat 1 is held inside of housing 3 by a keeper ring 9. Upper seat 1 has an outer surface which is spherical or arcuate or rounded in shape to allow seat 1 to rotate relatively with respect to lower seat 2 to improve the alignment at A to enhance the quality of the seal in the closed position of FIG. 3. Seal 11 on the outer surface of valve seat 1 prevents fluid from flowing between upper seat 1 and housing 3. In operation to open, the pressure from above orients upper seat 1 while flow through upper seat 1 pushes lower seat 2 away from seat 1 to allow flow through the mandrel 8.

Those skilled in the art will appreciate that either the upper seat or the lower seat or both can rotate in a way that skews its respective longitudinal axis to promote better alignment in the closed position at location A. As an option at A the seats 1 and 2 can meet as a metal to metal seal or there can also be at least one resilient seal at the interface A.

We claim:

1. A valve for use in inserting or removing tubulars from a wellbore, comprising:

a housing having a housing passage extending between ends thereof;

first and second members disposed in said housing passage to close said housing passage when said members contact and to allow flow through said housing passage when said members are moved out of contact, at least one of said members having more than one degree of freedom of movement;

said first member translates axially along said housing passage and further comprises a first through passage that skews about a center of rotation located on an axis of said housing passage.

2. The valve of claim 1, wherein:

said first member also rotates about the axis of said housing passage.

3. The valve of claim 1, wherein:

said first member further comprises a seat that further comprises a seat through passage that forms a part of said first through passage and said seat skews relative to said housing passage about a center of rotation located on an axis of said seat through passage.

4. The valve of claim 3, wherein:

said seat also rotates about the axis of said housing passage.

5. The valve of claim 1, wherein:

said first member having an annular shape defining said first through passage;

said second member having an annular shape with a second through passage aligned with said first through passage, said second through passage comprising a check valve.

6. The valve of claim 5, wherein:

said second member having an annular passage surrounding said second through passage that is selectively blocked when said first and second members are in contact.

7. The valve of claim 6, wherein:

said second through passage having a lower end and said check valve preventing flow through said lower end of said second through passage when said first and second members are in contact.

8. The valve of claim 7, wherein:

said check valve is bypassed with pressure that opens said annular passage by moving said first member away from said second member against a bias force.

9. A valve for use in inserting or removing tubulars from a wellbore, comprising:

a housing having a housing passage extending between ends thereof;

first and second members disposed in said housing passage to close said housing passage when said members contact and to allow flow through said housing passage when said members are spaced apart, at least one of said members having more than one degree of freedom of movement;

said first member translates axially along said housing passage and further comprises a first through passage that skews about a center of rotation located on an axis of said housing passage;

said first member having an annular shape with a first through passage;

said second member having an annular shape with a second through passage aligned with said first through passage, said second through passage comprising a check valve;

said second member having an annular passage surrounding said second through passage that is selectively blocked when said first and second members are in contact;

said second through passage having a lower end and said check valve preventing flow through said lower end of said second through passage when said first and second members are in contact;

said check valve is bypassed with pressure that opens said annular passage by moving said first member away from said second member against a bias force;

said bias is applied to a mandrel that has a rounded or arcuate end in contact with said first member.

10. The valve of claim 9, wherein:

said mandrel has a mandrel passage aligned with said first and second through passages.

11. The valve of claim 10, wherein:

said mandrel is biased by a spring.

12. The valve of claim 11, wherein:

said first member also rotates about the axis of said housing passage.

13. The valve of claim 11, wherein:

said first member further comprises a seat that further comprises a seat through passage that forms a part of said first through passage and said seat skews relative to said housing passage about a center of rotation located on an axis of said seat through passage.

14. A valve for use in inserting or removing tubulars from a wellbore, comprising:

a housing having a housing passage extending between ends thereof;

first and second members disposed in said housing passage to close said housing passage when said members contact and to allow flow through said housing passage when said members are spaced apart, at least one of said members having more than one degree of freedom of movement;

said first member translates axially along said housing passage and skews relative to said through passage about a center of rotation located on an axis of said housing passage;

said first member further comprises a seat that further comprises a seat through passage that forms a part of said first through passage and said seat skews relative to said housing passage about a center of rotation located on an axis of said seat through passage;

said seat has an arcuate or rounded shape and is supported by a conforming shape in the housing that surrounds said housing passage.

15. A valve for use in inserting or removing tubulars from a wellbore, comprising:

a housing having a housing passage extending between ends thereof;

first and second members disposed in said housing passage to close said housing passage when said members contact and to allow flow through said housing passage when said members are spaced apart, at least one of said members having more than one degree of freedom of movement; and at least one of said members has a rounded or arcuate surface so that one of said degrees of freedom allow said member to turn askew to an axis of said housing passage.

* * * * *